US005240115A

United States Patent [19]

Crossley et al.

[11] Patent Number: 5,240,115

[45] Date of Patent: Aug. 31, 1993

[54] FIELD ADJUSTABLE HYDROCYCLONE

[75] Inventors: Bruce Crossley, Pittsfield; Ronald DeFoe, Becket, both of Mass.

[73] Assignee: Beloit Technologies, Inc., Wilmington, Del.

[21] Appl. No.: 973,873

[22] Filed: Nov. 10, 1992

[51] Int. Cl.[5] ..... B03D 1/14

[52] U.S. Cl. ..... 209/211; 209/144; 210/512.1; 96/204

[58] Field of Search ..... 209/211, 144; 210/512.1, 512.3, 360.1, 221.2; 55/203, 204, 205, 459.1–459.5

[56] References Cited

U.S. PATENT DOCUMENTS

| | | | |
|---|---|---|---|
| 2,954,871 | 10/1960 | Lummus et al. | 209/211 |
| 3,358,833 | 12/1967 | Cantrell | 209/211 |
| 3,385,437 | 5/1968 | Woodruff | 209/211 |
| 3,764,005 | 10/1973 | Zemanek | 209/211 |
| 3,893,914 | 7/1975 | Bobo | 209/211 X |
| 4,278,534 | 7/1981 | Jakobson | 209/211 |
| 4,400,267 | 8/1983 | Brose | 209/211 |
| 4,793,925 | 12/1988 | Duvall et al. | 209/211 X |
| 4,919,796 | 4/1990 | Vikiö209 | 211/ |
| 5,028,318 | 7/1991 | Aslin | 209/211 X |

*Primary Examiner*—D. Glenn Dayoan

*Attorney, Agent, or Firm*—Dirk J. Veneman; Raymond W. Campbell

[57] ABSTRACT

An improved hydrocyclone and method of operating for centrifugal cleaning of pulp for papermaking wherein the hydrocyclone has a plurality of inserts each with openings of different sizes for selectively and interchangeably inserting into a stock entry opening and into a vortex finding outlet opening to adjust capacity and cleaning efficiency. In one form the inserts each can be changed by tubes of different openings which are installed into the inserts changing the opening sizes. In another form, the inserts are threadedly engaged with bosses or are adhered or frictionally fit into the bosses.

12 Claims, 1 Drawing Sheet

FIELD ADJUSTABLE HYDROCYCLONE

BACKGROUND OF THE INVENTION

The invention relates to improvements in the papermaking field, and more particularly to an improved method and apparatus for cleaning of papermaking pulp utilizing a hydrocyclone.

An important field of use for centrifugal separators is in the purifying of paper stock wherein wood pulp fibers are suspended in a water solution. In the operation of a centrifugal separator or hydrocyclone, the solution of pulp is directed into the hydrocyclone and the particles are separated in categories based on physical properties. The pulp solution is directed tangentially into the hydrocyclone chamber where, under the influence of centrifugal force, the particles are separated so that reject particles of a specific weight greater than the pulp, such as bark, shives, nodules, sand, ink specks, and the like are thrown outwardly and will pass downwardly through a reject opening at the base of the hydrocyclone chamber. The acceptable fraction which is the wood pulp fiber will pass outwardly through an opening at the top center of the hydrocyclone chamber. In other hydrocyclone type cleaners, lightweight particles, that is particles having specific weights less than the pulp, can be separated using the same principles.

Typically in commercial installations for the high efficiency removal of debris in paper stock, a plurality of hydrocyclone cleaners are connected in cleaner banks to process a substantial volume of paper stock. The hydrocyclone centrifugal cleaners may be used in a batch dump operation or a continuous operation. In each operation, the cleaner must be efficient and highly effective in removing the particles of contaminants, either heavyweight or lightweight.

Typically, with an installed cleaning system, there is limited capability to adjust either capacity or cleaning efficiency without changing the type or number of installed cleaners. Generally, the only means presently available is to adjust the consistency of the stock supplied either up or down and/or to adjust the operating pressures of the system. Raising the operating consistency yields a higher tonnage through the system but will lower the cleaning efficiency. Conversely, lowering the stock consistency can increase the cleaning efficiency but will lower the system output unless additional cleaners are added to the system. Running the cleaners at a higher pressure drop will raise the capacity, but the effect on cleaning efficiency can be positive or negative, depending on the specifics of the hydrocyclone and the contaminant involved.

Hydrocyclone geometry affects both the capacity and efficiency of the hydrocyclone. The limiting factors are the basic cleaner diameter and the ratio of the inlet orifice size and the overflow or vortex finder size to the cleaner's diameter. Therefore, system changes can be made without altering stock consistency or system pressures; however, previously geometric charges to the cleaners required substantial systems downtime and expense.

A feature of the present invention is to provide an improved apparatus and method for the cleaning of pulp utilizing a hydrocyclone for the removal of undesirable particles.

A further feature of the invention is to provide an improved cleaning system using hydrocyclones for the cleaning of papermaking pulp wherein the performance of the cleaner can be readily affected by adjusting the inlet orifice and vortex finder diameters.

A still further feature of the invention is to provide a hydrocyclone cleaning system which is field adjustable to obtain a more versatile system to accommodate changing mill requirements and wherein there is a capability to adjust either capacity or cleaning efficiency without changing the number or type of installed hydrocyclone cleaners.

SUMMARY OF THE INVENTION

The present invention provides a hydrocyclone cleaning system wherein one or more hydrocyclones are provided having a cyclone chamber therein of uniform acceptable size for a plurality of cleaning needs. The hydrocyclone has a tangential pulp inlet and an accept outlet at the top. Uniquely constructed interchangeable inlet nozzles and vortex finder tubes of varying diameters are provided, and interchange is made between inlets and vortex finders in an existing system to obtain a change in capacity or cleaning efficiency. The inlets and vortex finders have constructions so that they accommodate easy change in the field and can be replaced readily when needed, without disabling or disassembling the entire system.

Other objects, advantages and features will become more apparent with the teaching of the principles of the present invention in connection with the disclosure of the preferred embodiments thereof in the specification, claims and drawings, in which:

DESCRIPTION OF THE PREFERRED EMBODIMENTS

Figure 1:
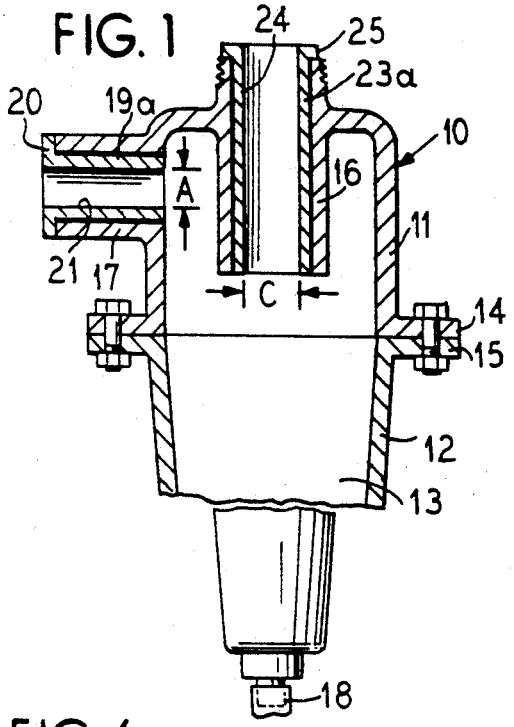
FIG. 1 is a vertical sectional view, shown in somewhat schematic form of a hydrocyclone embodying the principles of the present invention.

FIG. 1 illustrates a hydrocyclone 10 of the type which may be used singly or in groups for the cleaning of papermaking pulp. While the features of the invention find primary utilization in the cleaning of paper pulp, it will be understood that the features may be employed in other types of hydrocyclone cleaners such as may be used in the separation of solids in water supply systems, for removal in waste treatment plants, for bark separation in hydraulic barker systems and other commercial utilizations.

The hydrocyclone 10 of FIG. 1 has an upper portion 11 bolted to a lower portion 12 to form a hydrocyclone centrifugal cleaning chamber 13 therein. The upper section has an annular flange 14 matching a flange 15 of the lower section so that the two sections can be secured together by bolts as illustrated. It will be recognized by those skilled in the art, that the physical orientation of centrifugal cleaners is not necessarily critical to their operation. The forces occurring during operation dominate the cleaners performance such that cleaners will operate on their side or even inverted from the position shown in FIG. 1. The terms top, bottom, upper, lower and the like which imply physical orientation will be used herein only for clarity in explanation relative to the drawings and should not be considered limiting in term of the use or operation of the cleaners.

At the lower end of the chamber 13 is a reject opening 18 where the reject materials are discharged. In the case of pulp cleaning, such rejects will normally include the usual contaminants including particles of bark, shives, chop, fine sand and other materials which remain in the pulp with the preceding processing.

Pulp slurry is directed tangentially into the chamber 13 through an inlet insert 19*a*. The inlet is in the form of a sleeve which is frictionally inserted into an annular hollow boss 17 on the housing. The insert 19*a* has an opening 21 of a diameter A. While the inlet opening 21 has a cylindrical shape, in some instances other shapes such as oval or rectangular may be employed. The insert has an annular flange 20 to limit its insertion into the boss 17.

Figure 2:
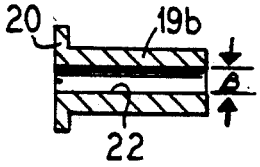
FIG. 2 is a fragmentary vertical sectional view of an insert for the stock entry opening of the cyclone of FIG. 1.
Figure 3:
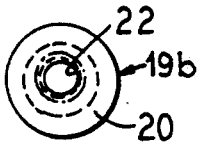
FIG. 3 is an end elevational view of the insert of FIG. 2.

In accordance with the principles of the present invention, a plurality of inserts are provided with an alternate insert 19*b* shown in FIGS. 2 and 3. This insert has an external diameter so that it can be inserted into the boss 17 after the insert 19*a* is withdrawn, and has an internal bore or opening 22 of a diameter B which is of different size than the diameter A, and is shown in the drawings as being smaller. A flange 20 of the insert 19*b* limits its insertion into the boss. The operator can selectively choose the insert 19*a* or 19*b* to change the effective size of the stock entry opening which leads tangentially into the chamber 13.

The plurality of inserts can also be used to provide a plurality of inlet configurations. Thus, by changing inserts the inlet design can be changed from cylindrical to conical, or even rectangular.

The upper end of the chamber 13 is provided with an annular boss 16 adapted to receive an insert 23*a*. The insert 23*a* has a flange 25 at its upper end to fit snugly into the boss 16 and has a central overflow or vortex finder opening 24 of a diameter C.

Figure 4:
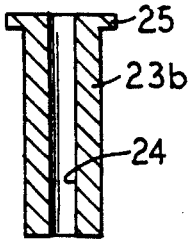
FIG. 4 is a detailed vertical sectional view of the insert for the vortex finder opening of the cyclone of FIG. 1.
Figure 5:
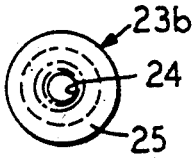
FIG. 5 is a top plan view of the insert of FIG. 4.

A plurality of vortex finder inserts are provided with another being illustrated in FIGS. 4 and 5 at 23*b*. These are provided with flanges 25 and have a flow opening 24 therethrough of a diameter D which is shown to be smaller than the diameter C of the insert 23*a*. The operator can remove the inset 23*a* and substitute therefor the inset 23*b* to obtain a smaller vortex finder opening. It will be seen that by providing a plurality of inserts such as 23*a* and 23*b* for the vortex finder opening, different sizes of opening from the chamber 13 can be achieved. Also by having a plurality of inserts such as 19*a* and 19*b*, the operator can selectively choose the inlet flow opening. By changing these openings selectively, the operator has the capability to adjust either the capacity of cleaning efficiency without changing the type or number of hydrocyclone cleaners. The limiting factors of operating are the basic cleaner size and the ratio of the inlet orifice size and the overflow or vortex finder size to the cleaner's diameter and these can be selectively changed for optimum performance within the parameters of the circumstance of cleaning at which the mill is operating.

The inlet inserts 19*a* and 19*b* and the vortex finder inserts 23*a* and 23*b* can be frictionally fit into the respective bosses 17 and 16. Alternatively, adhesive can be used to secure the inserts in the bosses.

Figure 6:
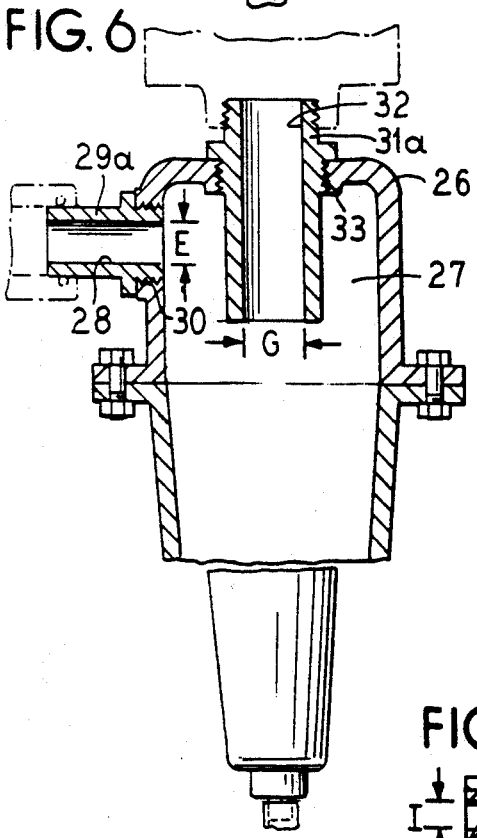
FIG. 6 is a vertical sectional view, shown in somewhat schematic form of a modified form of cyclone embodying the principles of the present invention.

In FIG. 6 a modified form of cleaner 26 is shown having a hydrocyclone chamber 27 therein. In the arrangement of FIG. 6, the interchangeable inserts for the stock entry opening and for the overflow opening are threaded into place, rather than press fit into place as in the arrangement shown in FIG. 1.

In FIG. 6 a stock inlet insert 29*a* is provided with threads at 30 for threading into the housing of the cleaner. The insert ha an inner diameter E to provide a flow passage 28 tangentially into the chamber 27.

Figure 7:
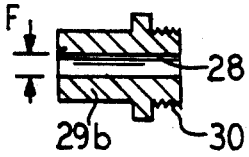
FIG. 7 is a detailed sectional view taken through an insert for the stock entry opening of the cyclone of FIG. 6.
Figure 8:
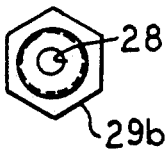
FIG. 8 is an end elevational view of the insert of FIG. 7.

An alternate insert is shown in FIGS. 7 and 8 having a smaller flow opening 28 of a diameter F. This insert 29*b* is threaded at 30 for interchangeable insertion into the hydrocyclone housing.

Figure 9:
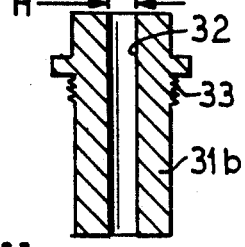
FIG. 9 is a vertical sectional view taken through an insert for the vortex finder opening of the cyclone of FIG. 6.
Figure 10:
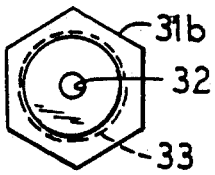
FIG. 10 is a top plan view of the insert of FIG. 9.

A vortex finder overflow opening is provided by an insert 31*a*. Having a flow opening 32 of a diameter G. An alternate insert is shown in FIGS. 9 an 10 at 31*b* having a smaller flow opening 32 of a diameter H. The inserts 31*a* and 31*b* are each threaded at 33 for interchangeability into the cyclone housing. Additional inserts may be provided of different size openings.

Figure 11:
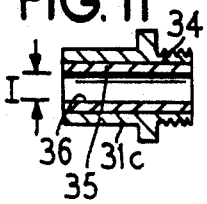
FIG. 11 is a sectional view taken through the axis of a modified form of insert for the vortex finder opening of the cyclone of FIG. 6.
Figure 12:
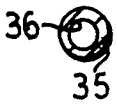
FIG. 12 is an end view of a portion of the structure of FIG. 11.
Figure 13:
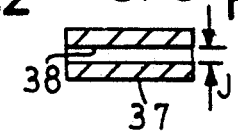
FIG. 13 is a vertical sectional view taken through a plastic insert for the structure of FIG. 11.
Figure 14:
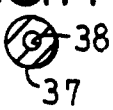
FIG. 14 is an end view of the structure of FIG. 13.

A modified form of insert may be provided shown in FIG. 11 wherein a housing insert 31*c* can be threaded into the opening into the chamber 27. For this arrangement, a single housing is provided and the housing has a central bore for the insertion of sleeves or tubes 35. The tube 35 is pressed into the housing and has a flow opening 36 of a diameter I. A single housing such as 31*c* may be employed, and to change the diameter of the opening, other tubes or sleeves 37 may be provided. An alternate tube 37 is shown in FIGS. 13 and 14 and has a central opening 38 of a diameter J which is smaller than the diameter I. This arrangement utilizes a simplified structure wherein only one insert may be provided and tubes of substantial number of varying size may be used to obtain the exact flow opening size required. A similar structure may be employed for the insert 29*a* wherein tubes of different sizes may be selectively used.

In use and operation the operator removes the stock entry insert 29*a* and the overflow opening insert 31*a* to substitute other inserts of different size openings. Thereby for a given hydrocyclone, the operator can change either the capacity or cleaning efficiency without having to install a new hydrocyclone cleaner. This reduces the capital investment of a plant, and allows for quicker or easier alteration of the operation. Such alteration can readily occur when the quality or quantity of the stock being processed changes so that the capacity and efficiency and overall capability of a plant is enhanced.

Thus, it will be seen there has been provided an improved hydrocyclone cleaning arrangement for the cleaning of papermaking pulp which provides a cleaning arrangement offering capabilities heretofore not available except with the changing of the actual cyclone chamber geometry. Field adjustment of the hydrocyclone has been simplified.

We claim as our invention:

1. A centrifugal hydrocyclone pulp cleaner for stock systems, for the cleaning of pulp for papermaking, comprising in combination:

a hydrocyclone body having an inner conical chamber wherein a vortex is created for the cyclonic separation of pulp from contaminants in a slurry;

a reject opening from the chamber at a tapered end for the rejection of the contaminants separated from the pulp within the chamber;

a stock entry opening leading tangentially into an end of the chamber for the entry of a liquid slurry suspension of pulp to be cleaned;

an outlet opening leading from the chamber for the outflow of cleaned pulp;

a plurality of removable entry inserts sized to be fixedly attached into said entry opening, each of said entry inserts having a flow opening of a different size for selectively controlling the quantity of slurry entering the chamber by selecting one of said plurality of inserts to be used in said entry opening;

and a plurality of removable vortex finder inserts sized to be fixedly attached to said body at said outlet opening, each of said vortex finder inserts having a flow opening of different size for selectively controlling the size of the opening leading from the chamber so that the capacity and efficiency is selectively controlled for a given cyclone body.

2. A centrifugal hydrocyclone pulp cleaner for stock systems, for the cleaning of pulp for papermaking, constructed in accordance with claim 1:

including means for securably holding said entry insert in said entry opening;

and means for securably holding the vortex finder insert in the outlet opening.

3. A centrifugal hydrocyclone pulp cleaner for stock systems, for the cleaning of pulp for papermaking, constructed in accordance with claim 2:

wherein said holding means for each of the openings is in the form of a male and female thread between the insert and the cyclone body.

4. A centrifugal hydrocyclone pulp cleaner for stock systems, for the cleaning of pulp for papermaking, constructed in accordance with claim 2:

wherein said holding means includes an annular flange at an outer edge of the insert and a friction fit between the insert and the opening.

5. A centrifugal hydrocyclone pulp cleaner for stock systems, for the cleaning of pulp for papermaking, constructed in accordance with claim 1:

wherein each of said entity inserts has a cylindrical opening of uniform diameter extending therethrough, and tubular sleeves are receivable by said entry inserts, said sleeves having flow openings of different diameters.

6. A centrifugal hydrocyclone pulp cleaner for stock systems, for the cleaning of pulp for papermaking, constructed in accordance with claim 1:

wherein each of said vortex finder inserts has a cylindrical opening of uniform diameter extend therethrough and tubular shaped sleeves are receivable by said vortex finder inserts, said sleeves having flow openings therein of different diameters.

7. A centrifugal hydrocyclone pump cleaner for stock systems, for the cleaning of pulp for papermaking, constructed in accordance with claim 1:

wherein said inserts are secured in said openings by adhesive.

8. A centrifugal hydrocyclone pulp cleaner for stock systems, for the cleaning of pulp for papermaking, constructed in accordance with claim 1:

wherein said inserts are secured in bosses at said openings through threaded engagement between said inserts and said bosses.

9. A centrifugal hydrocyclone pulp cleaner for stock systems, for the cleaning of pulp for papermaking, comprising in combination:

a hydrocyclone body having an upper portion with an annular flange at the lower edge and having a lower portion with an annular flange at an upper edge for attachment to the annular flange of the upper portion, said upper and lower portions defining therein a frusto-conically shaped cyclone chamber;

means defining an outlet opening at an apex lower end of the lower portion for rejection of foreign particles separated within the chamber;

a plurality of stock entry inserts each having cylindrical passages therethrough of different diameters and being externally threaded for alternatively threading into an entry opening in the upper part of the cyclone body extending tangentially into the chamber;

and a plurality of vortex finding outlet opening inserts each having a cylindrical passageway therethrough of different diameters and each being threaded to be alternately threadably connected to an outlet opening at a top of the upper end of the cyclone body so that the capacity and efficiency of the cyclone can be adjustably changed by interchanging inserts.

10. The method of centrifugal cleaning of pulp for papermaking utilizing a hydrocyclone comprising the steps:

directing a flow of papermaking pulp with foreign elements to be removed into a tangential stock entry opening in a hydrocyclone while removing cleaned stock through a vortex finding outlet opening at the cyclone top and removing foreign particles from a reject opening at the cyclone bottom;

and adjusting capacity and cleaning efficiency by selectively installing one of a plurality of inserts each with different opening sizes into the stock entry opening for varying the operation of the cyclone.

11. The method of centrifugal cleaning of pulp for papermaking utilizing a hydrocyclone in accordance with the steps of claim 10:

wherein the capacity and cleaning efficiency of the hydrocyclone are adjusted by selectively installing inserts with openings of different sizes in the outlet opening at the cyclone top.

12. The method of centrifugal cleaning of pulp for papermaking utilizing a hydrocyclone in accordance with the steps of claim 10:

including selectively and dependently inserting one of a plurality of inserts each with different opening sizes into both the stock entry opening and the vortex finding overflow opening thereby adjusting the capacity and cleaning efficiency of the hydrocyclone.

* * * * *